US005281890A

United States Patent [19]

Kane

[11] Patent Number: 5,281,890

[45] Date of Patent: Jan. 25, 1994

[54] FIELD EMISSION DEVICE HAVING A CENTRAL ANODE

[75] Inventor: Robert C. Kane, Woodstock, Ill.

[73] Assignee: Motorola, Inc., Schaumburg, Ill.

[21] Appl. No.: 605,862

[22] Filed: Oct. 30, 1990

[51] Int. Cl.[5] ..... H01J 1/30

[52] U.S. Cl. ..... 313/309; 313/351

[58] Field of Search ..... 313/308, 309, 336, 351, 313/618

[56] References Cited

U.S. PATENT DOCUMENTS

| | | | |
|---|---|---|---|
| 3,755,704 | 8/1973 | Spindt et al. | 313/309 |
| 3,789,471 | 2/1974 | Spindt et al. | 29/25.17 |
| 3,812,559 | 5/1974 | Spindt et al. | 29/25.18 |
| 3,894,332 | 7/1975 | Nathanson et al. | 313/309 |
| 3,921,022 | 11/1975 | Levine | 313/309 |
| 3,970,887 | 7/1976 | Smith et al. | 72/56 |
| 3,998,678 | 12/1976 | Fukase et al. | 313/309 |
| 4,008,412 | 2/1977 | Yuito et al. | 313/309 |
| 4,178,531 | 12/1979 | Alig | 313/409 |
| 4,307,507 | 12/1981 | Gray et al. | 313/309 |
| 4,513,308 | 4/1985 | Greene et al. | 313/309 |
| 4,578,614 | 3/1986 | Gray et al. | 313/309 |
| 4,685,996 | 8/1987 | Busta et al. | 156/628 |
| 4,721,885 | 1/1988 | Brodie | 313/576 |
| 4,827,177 | 5/1989 | Lee et al. | 313/306 |
| 4,874,981 | 10/1989 | Spindt | 313/309 |
| 4,901,028 | 2/1990 | Gray et al. | 330/54 |

FOREIGN PATENT DOCUMENTS

| | | |
|---|---|---|
| 0172089 | 7/1985 | European Pat. Off. . |
| 2604823 | 10/1986 | France . |
| 855782 | 6/1977 | U.S.S.R. . |
| 2204991A | 11/1988 | United Kingdom . |

OTHER PUBLICATIONS

A Vacuum Field Effect Transistor Using Silicon Field Emitter Arrays, by Gray, 1986 IEDM.

Advanced Technology: flat cold-cathode CRTs, by Ivor Brodie, Information Display Jan. 1989.

Field-Emitter Arrays Applied to Vacuum Flourescent Display, by Spindt et al. Jan., 1989 issue of IEE Transactions on Electronic Devices.

Field Emission Cathode Array Development for High--Current Density Applications for Spindt et al., dated Aug., 1982 vol. 16 of Applications of Surface Science.

*Primary Examiner*—Sandra L. O'Shea
*Assistant Examiner*—Michael Horabik
*Attorney, Agent, or Firm*—Eugene A. Parsons

[57] ABSTRACT

A field emission device providing electric-field induced electron emission includes an annular edge emitter for emission of electrons. Emitted electrons are collected, at least in part, by an anode centrally disposed with respect to the annular edge emitter.

34 Claims, 4 Drawing Sheets

FIELD EMISSION DEVICE HAVING A CENTRAL ANODE

TECHNICAL FIELD

This invention relates generally to cold-cathode field emission devices and in particular to cold-cathode field emission devices employing non-conical emitting edges, and is more particularly directed toward devices having a central anode of conductive or semi-conductive material, an annular emitting edge, and annular gate extraction electrodes.

BACKGROUND OF THE INVENTION

Cold-cathode field emission devices (FEDs) are known in the art. These FEDs employ an electric field in concert with a geometric discontinuity of small radius of curvature to reduce the potential barrier and provide for increased electron tunneling from the surface of the emitter electrode. In many practical devices, the electric field is realized by supplying a voltage between the electron emitters and a gate extraction electrode. These prior art FEDs may be formed by a variety of methods, all of which yield structures with the primary purpose of emitting electrons from an emitter electrode.

In some prior art embodiments, the emitted electrons are collected by an anode that resides on a supporting structure. The anode supporting structure is generally made of insulating material and resides on the structure in which emitter electrodes and gate extraction electrodes have been formed. In other prior art embodiments, an anode may be disposed substantially co-planar with an electron emitting tip.

Although these prior art FEDs are functional, they suffer from a number of shortcomings. First, anode placement in those embodiments employing non-coplanar anodes is difficult to realize; non-coplanar FEDs require complex fabrication methods. In addition, for structures employing co-planar anode electrodes, electron emission is effected from individual sharp tips that do not maximally benefit from electric field enhancing effects. Accordingly, a need arises for an improved FED that does not suffer from these deficiencies.

SUMMARY OF THE INVENTION

The above-described need is satisfied through the FED structure disclosed herein. Pursuant to this invention, a central anode of conductive or semiconductive material provides a foundation for construction of the device, which also includes an annular emitting edge, and annular gate extraction electrodes.

In one embodiment, a series of selective etch and oxide growth/deposition steps is employed during the formation process to yield a device with an annular emitter electrode and annular gate extraction electrodes, each electrically isolated from and concentrically located with respect to a central anode electrode. This structure does not require the complex deposition processes of the prior art, nor does it suffer from prior art electron emission restrictions.

According to the invention, a field emission device is provided comprising a substrate and a central anode extending from a first surface of the substrate. A first gate extraction electrode is disposed on at least a part of the first surface of the substrate and further disposed substantially annularly and concentrically about at least a portion of the central anode.

A first insulator layer is disposed on at least a part of the first surface of the substrate and further disposed substantially annularly and concentrically about at least a portion of the central anode. A conductive emitter electrode is disposed on at least a part of the first insulator layer and further disposed substantially annularly and concentrically about at least a portion of the central anode.

A second insulator layer is disposed on at least a part of a surface of the conductive emitter electrode and further disposed substantially annularly and concentrically about at least a portion of the central anode. A second gate extraction electrode layer is disposed on at least a part of a surface of the second insulator layer and further disposed substantially annularly and concentrically about at least a portion of the central anode.

In still other embodiments of the invention, additional conductive layers may be employed forming tetrode or pentode structures where suitable potentials may be applied to the subsequent electrodes to yield desired operation.

BEST MODE FOR CARRYING OUT THE INVENTION

Figure 1:
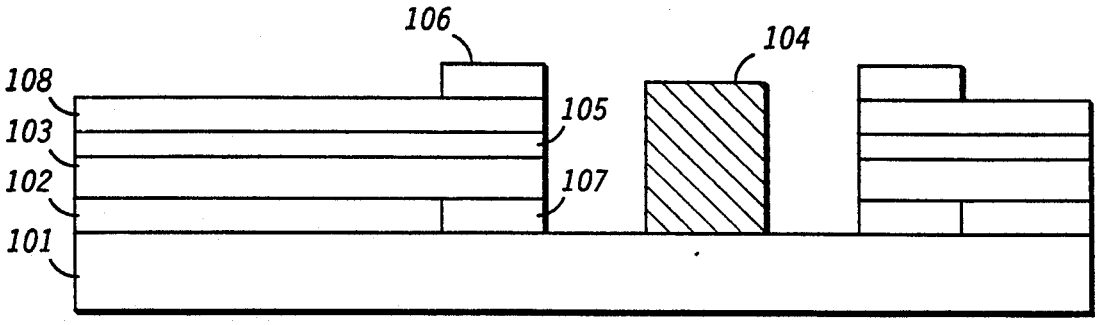
FIG. 1 is a side elevational cutaway view of an FED structure, including an emitter electrode, gate extraction electrodes, and central anode electrode.

FIG. 1 depicts a substrate (101) that has disposed on a surface a first insulator layer (102), a first gate extraction electrode layer (107), and an anode electrode layer (104). A second insulator layer (103) is shown disposed on a surface of the first insulator layer (102) and at least part of a surface of the first gate extraction electrode (107). An emitter electrode (105) is disposed on a surface of the second insulator layer (103). A third insulator layer (108) is disposed on a surface of the emitter electrode (105), and a second gate extraction electrode (106) is disposed on a part of a surface of the third insulator layer (108). In this embodiment, the first and second gate extraction electrodes (107 and 106) are symmetrically disposed about the annular electron emitting edge of the emitter electrode (105). So disposed, the first and second gate extraction electrodes (107 and 106) will provide for maximal electric field enhancement at the electron emitting edge of the emitter electrode (105). The first gate extraction electrode (107) and second gate extraction electrode (106) are generally operated at the same voltage in order that the gradient of the electric field at the emitting edge of the emitter electrode (105) be directed parallel to the plane of the emitter electrode (105). However, independent operation of the first and second gate extraction electrodes (107 and 106) will permit the emitted electron beam to be directed other than substantially parallel to the plane of the emitter electrode (105). The anode (104), which is designed to collect electrons emitted from the emitter electrode (105), is shown as extending from the substrate (101) to a height which will provide for effective collection of emitted electrons and may be lower in extent for structures wherein the anode (104) is realized with a larger diameter. Further, the anode (104) may be formed by many known methods, including, but not limited to, evaporative deposition and preferential etching of a semiconductor substrate material.

The first and second gate extraction electrodes (107 and 106) may be realized by depositing a pattern or layer of metallic material or doped semiconductor material. The first and second insulator layers (102 and 103) may, alternatively, be realized as a single insulator deposition or oxide growth. The emitter electrode and anode may each be realized independently by depositing a layer or pattern of metallic material or doped semiconductor material. So formed, the structure will operate as an FED wherein the anode (105) is centrally disposed with respect to an electron emitting annular edge.

Figure 2:
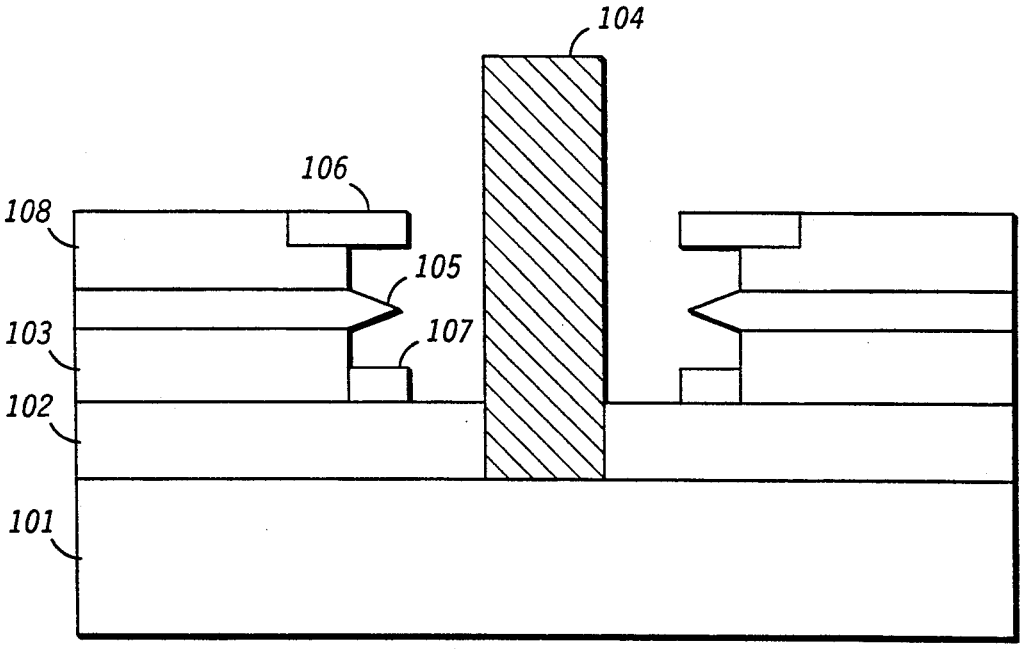
FIG. 2 is a side elevational cutaway view of an FED structure, including a preferentially formed emitter electrode, gate extraction electrodes, and central anode electrode.

FIG. 2 shows an alternative embodiment FED wherein the first gate extraction electrode (107) is disposed on the first insulator layer (102). Further, FIG. 2 depicts the emitter electrode (105) having a sharpened emitting edge. Sharpening of the emitting edge of the emitter electrode (105) provides a geometric discontinuity of reduced radius of curvature which will effectively reduce the voltage required between the emitter electrode (105) and first and second gate extraction electrodes (107 and 106) for suitable operation of the FED.

Figure 3:
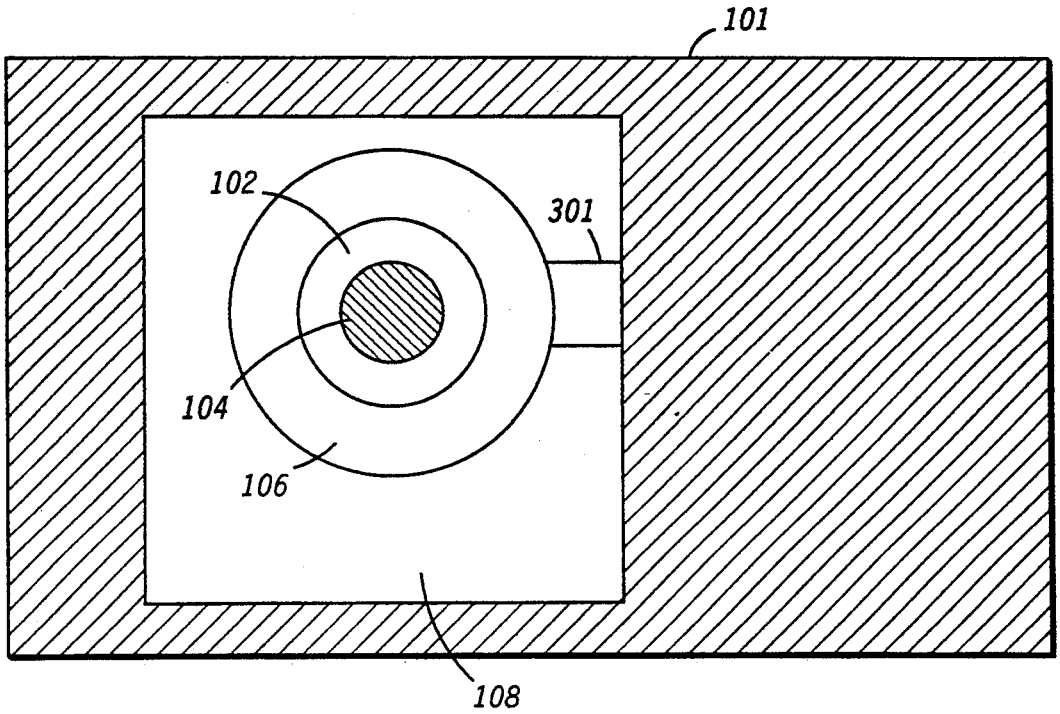
FIG. 3 is a top plan view of an FED formed with a central anode.

FIG. 3 is a top plan view of an FED of the present invention, constructed as described previously with reference to FIGS. 1 and 2. The FED shown provides for the second gate extraction electrode (106) to be formed as an annular ring disposed substantially symmetrically and peripherally about the central anode. A conductor stripe (301) is disposed on the third insulator layer (108) and operably coupled to the second gate extraction electrode (106). Similarly, the first gate extraction electrode and emitter electrode may be selectively patterned and operably coupled to respective associated conductor stripes, although these details are not shown in the figure for the sake of clarity.

Figure 4:
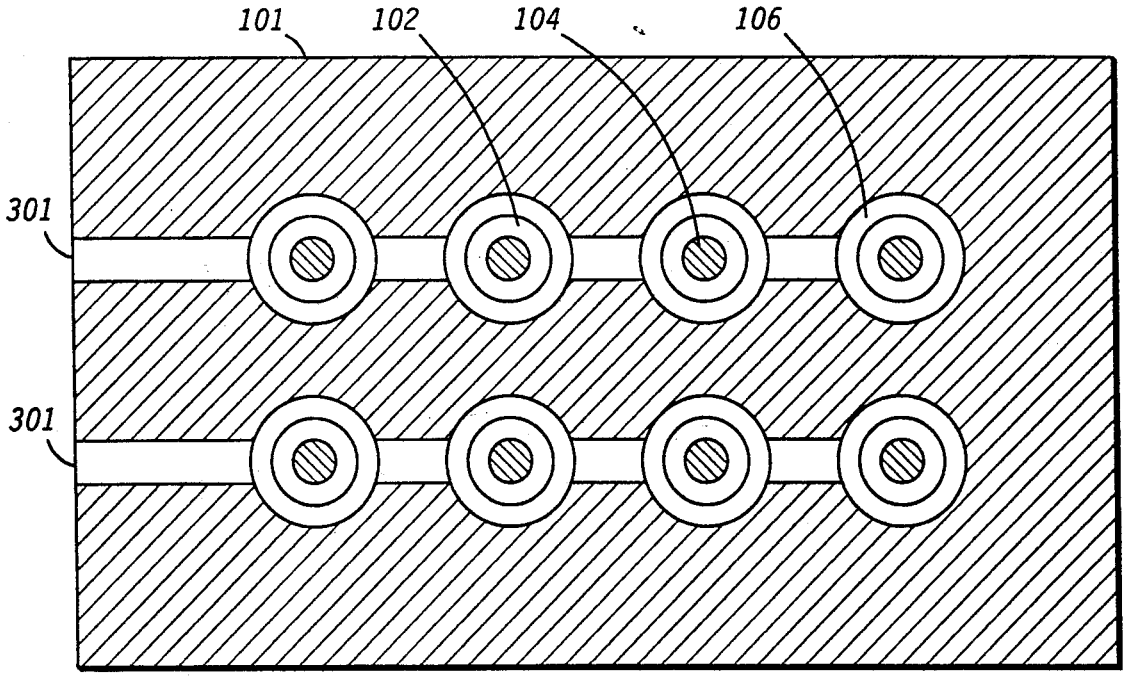
FIG. 4 is a top elevational view of an array of central anodes surrounded by a common emitter conductor located annularly about each anode.

FIG. 4 depicts an array of FEDs, constructed as described above with the reference to FIG. 3. The individual FEDs of the array are operably interconnected such that the individual FEDs of the array may be operated as groups of FEDs. For the embodiment shown, the individual second gate extraction electrodes (106) are interconnected by a plurality of conductive stripes (301) in a manner which forms rows of interconnected second gate extraction electrodes (106). The first gate extraction electrodes, not shown in the figure, may be similarly interconnected to form rows of operably coupled first gate extraction electrodes. The emitter electrodes (also not shown) may be selectively interconnected in a preferred group to form rows or columns of interconnected emitter electrodes. The central anodes (not shown) may also be interconnected to yield an electronic device comprised of an array of FEDs wherein the plurality of anodes of the array are substantially operably coupled to each other or where select groups of anodes are operably coupled only to other anodes of the same group.

Figure 5:
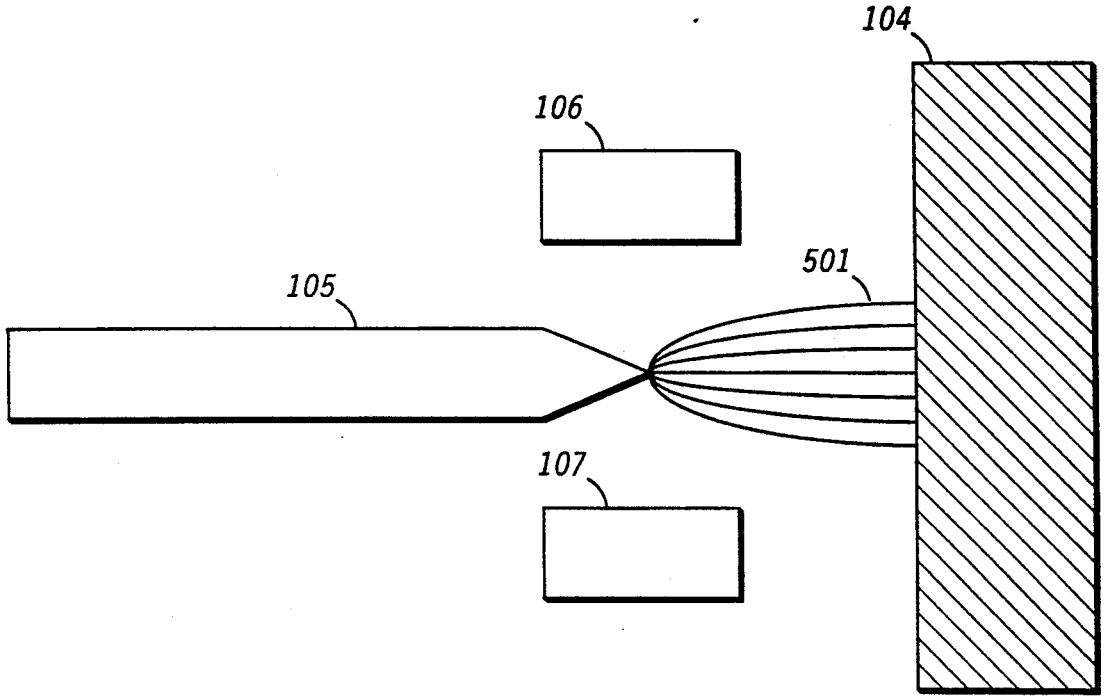
FIG. 5 is a side elevational view of FED electrodes.

FIG. 5 is a side elevational cross-sectional view of the electrodes of an FED constructed in accordance with the invention. An electron beam (501) is shown that is a representation of a possible beam configuration which may be realized by constructing an FED with the depicted configuration.

Figure 6:
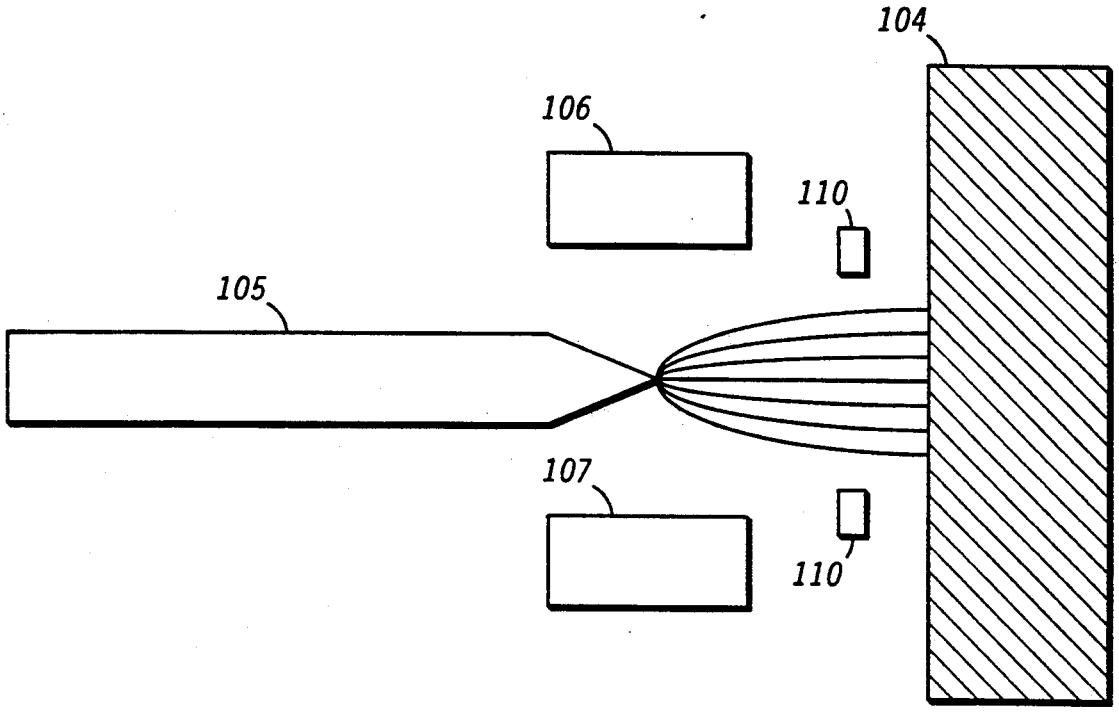
FIG. 6, is a side elevational view, similar to FIG. 5, of another embodiment of FED electrodes.

It is immediately obvious that the inclusion of (110), in FIG. 6, additional electrodes or electrode pairs, such as tetrode or pentode structures, in the intervening anode-emitter electrode space, will yield a device with additional control mechanisms. These additional control mechanisms may include electron emission control or focusing.

What is claimed is:

1. A field emission device comprising:

a substrate;

a central anode extending from a first surface of the substrate;

a first gate extraction electrode disposed on at least a part of the first surface of the substrate and further disposed substantially annularly and concentrically about at least a portion of the central anode;

a first insulator layer disposed on at least a part of the first surface of the substrate and further disposed substantially annularly and concentrically about at least a portion of the central anode;

a conductive emitter electrode disposed on at least a part of the first insulator layer and further disposed substantially annularly and concentrically about at least a portion of the central anode;

a second insulator layer disposed on at least a part of a surface of the conductive emitter electrode and further disposed substantially annularly and concentrically about at least a portion of the central anode;

a second gate extraction electrode layer disposed on at least a part of a surface of the second insulator layer and further disposed substantially annularly and concentrically about at least a portion of the central anode.

2. The field emission device of claim 1, further comprising:

at least one electrode disposed between the gate electrode layer and the anode electrode.

3. The field emission device of claim 2, wherein said at least one electrode functions as an electron emission controlling element.

4. The field emission device of claim 2, wherein said at least one electrode functions as a focusing element.

5. The field emission device of claim 1, wherein the central anode is formed by selective etching of the substrate.

6. The field emission device of claim 1, further comprising:

said emitter electrode having an electron emitting edge that has been preferentially etched to provide a reduced radius of curvature.

7. A field emission device comprising:

a substrate;

a central anode extending from a first surface of the substrate;

a first insulator layer disposed on at least a part of a first surface of the substrate and further disposed substantially annularly and concentrically about at least a portion of the central anode;

a first gate extraction electrode disposed on at least a part of a surface of the first insulator layer and further disposed substantially annularly and concentrically about at least a portion of the central anode;

a second insulator layer disposed on at least a part of a surface of the first insulator layer and further disposed substantially annularly and concentrically about at least a portion of the central anode;

a conductive emitter electrode disposed on at least a part of the second insulator layer and further disposed substantially annularly and concentrically about at least a portion of the central anode;

a third insulator layer disposed on at least a part of a surface of the conductive emitter electrode and further disposed substantially annularly and concentrically about at least a portion of the central anode;

a second gate extraction electrode layer disposed on at least a part of a surface of the third insulator layer and further disposed substantially annularly and concentrically about at least a portion of the central anode.

8. The field emission device of claim 7, further comprising:

at least one electrode disposed between the gate electrode layer and the anode electrode.

9. The field emission device of claim 8, wherein said at least one electrode functions as an electron emission controlling element.

10. The field emission device of claim 8, wherein said at least one electrode functions as a focusing element.

11. The field emission device of claim 7, wherein the central anode is formed by selective etching of the substrate.

12. The field emission device of claim 7, further comprising:

said emitter electrode having an electron emitting edge that has been preferentially etched to provide a reduced radius of curvature.

13. A field emission device comprising:

a substrate;

a plurality of central anodes extending from a first surface of the substrate;

a first gate extraction electrode disposed on at least a part of a first surface of the substrate and further disposed substantially annularly and concentrically about at least a portion of said plurality of central anodes;

first insulator layers disposed on at least a part of a first surface of the substrate and further disposed substantially annularly and concentrically about at least a portion of said plurality of central anodes;

at least one conductive emitter electrode disposed on at least a part of a surface of the first insulator layers and further disposed substantially annularly and concentrically about at least a portion of said plurality of central anodes;

a second insulator layer disposed on at least a part of a surface of the conductive emitter electrode and further disposed substantially annularly and concentrically about at least a portion of said plurality of central anodes;

a second gate extraction electrode disposed on at least a part of a surface of the second insulator layer and further disposed substantially annularly and concentrically about at least a portion of said plurality of central anodes.

14. The field emission device of claim 13, wherein the first gate extraction electrode comprises a plurality of electrically isolated regions disposed substantially peripherally and symmetrically about at least a portion of said plurality of central anodes.

15. The field emission device of claim 14, further comprising:

at least one conductive stripe, wherein said at least one conductive stripe operably interconnects at least some of said plurality of electrically isolated regions.

16. The field emission device of claim 13, further comprising:

a plurality of conductive emitter electrodes wherein said plurality of conductive emitter electrodes comprises a plurality of regions each of which is disposed substantially peripherally and symmetrically about at least a portion of said plurality of central anodes.

17. The field emission device of claim 16, further comprising:

at least one conductive stripe wherein said at least one conductive stripe operably interconnects at least some of said plurality of regions.

18. The field emission device of claim 13, further comprising:

at least one electrode disposed in an intervening space between the gate extraction electrodes and the anode.

19. The field emission device of claim 13, wherein the central anodes are formed by selective etching of the substrate.

20. The field emission device of claim 18, wherein said at least one electrode functions as an electron emission controlling element.

21. The field emission device of claim 18, wherein said at least one electrode functions as a focusing element.

22. The field emission device of claim 13, further comprising: said at least one conductive emitter electrode having an electron emitting edge that has been preferentially etched to provide a reduced radius of curvature.

23. The field emission device of claim 16, wherein at least some of said plurality of conductive emitter electrodes have electron emitting edges that have been preferentially etched to provide a reduced radius of curvature.

24. A field emission device comprising:

a substrate;

a plurality of central anodes extending from a first surface of the substrate;

a first insulator layer disposed on at least a part of a first surface of the substrate and further disposed substantially annularly and concentrically at least partially about at least a portion of said plurality of central anodes;

a first gate extraction electrode disposed on at least a part of a surface of the first insulator layer and further disposed substantially annularly and concentrically about at least a portion of said plurality of central anodes;

a second insulator layer disposed on at least a part of the first insulator layer and further disposed substantially annularly and concentrically about at least a portion of said plurality of central anodes;

at least one conductive emitter electrode disposed on at least a part of a surface of the second insulator layer and further disposed substantially annularly and concentrically about at least a portion of said plurality of central anodes;

a third insulator layer disposed on at least a part of the conductive emitter electrode and further disposed substantially annularly and concentrically about at least a portion of said plurality of central anodes;

a second gate extraction electrode disposed on at least a part of a surface of the third insulator layer and further disposed substantially annularly and concentrically about at least a portion of said plurality of central anodes.

25. The field emission device of claim 24, wherein the first gate extraction electrode comprises a plurality of electrically isolated regions disposed substantially peripherally and symmetrically about at least a portion of said plurality of central anodes.

26. The field emission device of claim 25, further comprising:

at least one conductive stripe, wherein said at least one conductive stripe operably interconnects at least some of said plurality of electrically isolated regions.

27. The field emission device of claim 24, further comprising:

a plurality of conductive emitter electrodes wherein said plurality of conductive emitter electrodes comprises a plurality of regions each of which is disposed substantially peripherally and symmetrically about at least a portion of said plurality of central anodes.

28. The field emission device of claim 27, further comprising:

at least one conductive stripe wherein said at least one conductive stripe operably interconnects at least some of said plurality of regions.

29. The field emission device of claim 24, further comprising:

at least one electrode disposed in an intervening space between the gate extraction electrodes and the anode.

30. The field emission device of claim 24 wherein the central anodes are formed by selective etching of the substrate.

31. The field emission device of claim 29, wherein said at least one electrode functions as an electron emission controlling element.

32. The field emission device of claim 29 wherein said at least one electrode functions as a focusing element.

33. The field emission device of claim 24, further comprising:

said at least one conductive emitter electrode having an electron emitting edge that has been preferentially etched to provide a reduced radius of curvature.

34. The field emission device of claim 27, wherein at least some of said plurality of conductive emitter electrodes have electron emitting edges that have been preferentially etched to provide a reduced radius of curvature.

* * * * *